United States Patent [19]

Knox

[11] 4,322,292

[45] Mar. 30, 1982

[54] AERATOR

[75] Inventor: Ronald W. Knox, Hockessin, Del.

[73] Assignee: RJD, Newark, Del.

[21] Appl. No.: 222,274

[22] Filed: Jan. 2, 1981

[51] Int. Cl.[3] ..... B01D 35/00; E03C 1/08

[52] U.S. Cl. ..... 210/198.1; 210/449; 210/460; 239/428.5; 261/76; 261/DIG. 75

[58] Field of Search ..... 210/198.1, 449, 460, 210/482; 239/428.5; 261/76, DIG. 75

[56] References Cited

U.S. PATENT DOCUMENTS

| | | | |
|---|---|---|---|
| 2,210,846 | 8/1940 | Aghnides | 210/460 X |
| 2,316,832 | 4/1943 | Aghnides | 261/76 |
| 2,771,998 | 11/1956 | Holden | 261/76 X |
| 2,832,577 | 4/1958 | Goodrie et al. | 239/428.5 X |
| 2,849,217 | 8/1958 | Bachli et al. | 239/428.5 X |
| 2,989,249 | 6/1961 | Richter | 239/428.5 X |
| 3,130,918 | 4/1964 | Aghnides | 239/428.5 |
| 3,143,299 | 8/1964 | Benjamin | 239/428.5 X |
| 3,208,595 | 9/1965 | Butler | 210/449 X |
| 3,341,132 | 9/1967 | Parkison | 239/428.5 X |
| 3,471,091 | 10/1969 | Baker | 239/416 |
| 3,684,191 | 8/1972 | Shames et al. | 239/428.5 |
| 3,884,418 | 5/1975 | Ritzenthaler | 239/428.5 |
| 3,902,671 | 9/1975 | Symmons | 239/428.5 |
| 3,938,738 | 2/1976 | Nagel | 239/9 |
| 3,985,303 | 10/1976 | Steimle | 239/428.5 |
| 4,072,270 | 2/1978 | Harmony | 239/428.5 |
| 4,191,332 | 3/1980 | DeLangis | 239/428.5 |

*Primary Examiner*—Robert H. Spitzer
*Attorney, Agent, or Firm*—Connolly and Hutz

[57] ABSTRACT

An aerator which is attached to a water faucet includes a flow control disc at its upstream end for providing a restricted water passageway and includes air passage means for directing atmospheric air at the stream of water to mix the air and water at the upstream end of the aerator.

14 Claims, 9 Drawing Figures

AERATOR

BACKGROUND OF INVENTION

The present invention is concerned with aerators such as conventionally used for attachment to a water faucet. Numerous attempts have been made in the prior art to provide satisfactory aerators. In general the degree of aeration is dependent on the velocity or flow rate. Typical flow rates with the prior art to achieve aeration are about 1.7 to 1.8 gallons per minute. It would be desirable to provide an arrangement which could achieve aeration at a substantially lower rate such as 0.5 gallons per minute to meet the BOCA code.

SUMMARY OF INVENTION

An object of this invention is to provide an aerator capable of aerating at a low flow rate.

A further object of this invention is to provide such an aerator which is effective in operation yet low cost in production.

In accordance with this invention, the aerator includes a body member which may be detachably secured to a water faucet and which includes a flow control member such as a disc at its upstream end thereof to provide a restricted passageway for the water. Air passage means are provided to direct atmospheric air at the emerging stream of water to accomplish the aeration or mixing at the upstream end of the body member. The aerator may also include a dispersal disc having a plurality of apertures therethrough at the downstream end of the mixing chamber with screen material at the discharge end of the body member.

In accordance with one embodiment of this invention, a sleeve is mounted in the body member coaxially therewith but spaced therefrom to create an annular space therebetween so that atmospheric air can enter the annular space and then flow between the flow control disc and an air channel forming disc mounted at the top of the sleeve. The flow control disc has a central frustoconical extension which is apertured so that the water flows therethrough and the outer surface of the extension acts as a guide surface for the air to direct it against the stream of water.

In accordance with a further embodiment of this invention, the air passage means includes a plurality of tubes extending upwardly and inwardly from the inner wall of the aerator body toward the frusto-conical extension of the flow control member.

In accordance with yet another embodiment of this invention, the air channel forming disc is disposed against and downstream from the flow control disc but includes a plurality of radial grooves in its upstream surface so as to direct the air from the outer edge of the air channel forming disc against the water emerging from the frusto-conical extension.

THE DRAWINGS

The following figures illustrate exemplary forms of this invention and are drawn to double-size scale.

DETAILED DESCRIPTION

Figure 1:
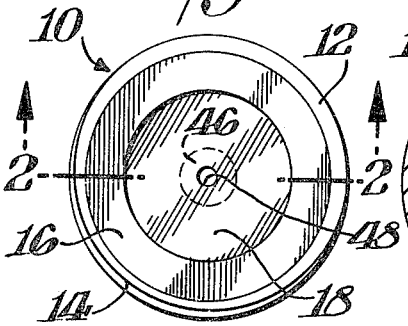
FIG. 1 is a top plan view of an aerator in accordance with one embodiment of this invention.

FIGS. 1–4 show an aerator 10 in accordance with one embodiment of this invention. As indicated therein, aerator 10 includes a body member 12 which is cylindrical in shape and which is opened both at its top and bottom ends (i.e., upstream and downstream ends). The upstream end of body member 12 is provided with suitable attaching means such as threaded portion 14 for detachable securement to a conventional faucet F. Obviously any type of attaching means can be used in accordance with the type of faucet to which aerator 10 is to be secured. Mounted within body member 12 is a gasket 16, a flow control member or disc 18 and a sleeve 20. Mounted within sleeve 20 near the upstream end thereof is an air forming channel disc 22, a spacer ring 24, then a dispersal disc 26, another spacer ring 28 and screen material 30, such as a pair of screen discs. Connected integrally with sleeve 20 is an annular flange 32 which rests against flow control member 18 and a plurality of longitudinal ribs 34 (FIG. 3) similar to the ribs **34*b* of FIG. 8**.

The various components are assembled by first inserting screen material 30 at the bottom or downstream end of sleeve 20 until screen material 30 rests against inturned flange 36. Next, spacer ring 28 is inserted on top of screen material 30 and then dispersal disc 26 is placed in sleeve 20 until it rests upon spacer sleeve 28 whereupon spacer sleeve 24 is then inserted following which air channel forming disc 22 is next placed on spacer sleeve 24. The assembled unit within sleeve 20 is then inserted in body member 12 until the rounded ends of ribs 34 rest against inturned flange 38 of body member 12. As later described, ribs 34 have the multiple functions of retaining sleeve 20 in body member 12, maintaining sleeve 20 coaxial with body member 12 and providing an air passage in the annular space created between sleeve 20 and body member 12. It is to be understood that ribs 34 need not be of one piece construction, but may simply include radial extensions from sleeve 20.

After sleeve 20 is inserted in body member 12, flow control disc 18 is then placed in body member 12 until flow control member 18 rests on flange 32. Gasket or washer 16 is then mounted in body member 12, and body member 12 is next added to faucet F.

Dispersal disc 26 is preferably located in sleeve 20 so as to partition sleeve 20 into a pair of chambers 40, 42 of equal volume. As later described, chamber 42 serves as a mixing chamber for air and water which then exits through dispersal disc 26 by means of a plurality of apertures 44 which are preferably arranged coarcuate with each other similar to aperture **44*a* of FIG. 6 and concentric to an axis of body member 12. Holes are slightly inclined outwardly to direct the water/air mixture toward the outer periphery of screen material 30**.

Flow control member or disc 18 includes a frusto-conical extension 46 having an axial opening or orifice 48 so as to provide a restricted passageway for the water supplied from faucet F. Air channel forming disc 42 includes a tapered opening 50 which conforms in size and shape to extension 46 so that the stream of water emerging from passageway or orifice 48 flows through opening 50 into mixing chamber 42. The flowing stream serves to draw in atmospheric air from air passage means apparently under a venturi effect whereby the air and water mix in chamber 42 to thereby aerate the water. The air passage means comprises the annular space 52 between inturned flange 38 and sleeve 20 and then the generally annular space between the inner wall of body member 12 and the outer wall of sleeve 20 as provided between ribs 34. Sleeve 20 includes a plurality of slots 54 at its upstream end thereof so that the air can then flow through the slots toward extension 46. The frusto-conical outer surface of extension 46 serves as a guide surface to then guide the air at an angle toward the stream of water emerging from orifice 48.

The stream of water exiting from orifice 48 would be traveling at a high velocity thereby creating a pressure drop in the immediate vicinity of the downstream end of orifice 48. This pressure differential causes air to be drawn from the atmosphere through the air passage where it mixes with the water in mixing chamber 42 as discussed above. The aerated water is then forced through the holes or apertures 44 in dispersal disc 26 and is then forced through screens 30 which creates a laminar stream of aerated water as it exits from aerator 10.

A particular distinction of the invention is in providing the mixing action of the air and water at the upstream end of the mixing chamber upstream from the dispersal disc 26. Such arrangement achieves aeration at virtually any flow rate desired, and meets or exceeds the BOCA code rate of 0.5 GPM, in contrast to presently attainable minimum flow rates of about 1.7 to 1.8 gallons per minute.

Figure 7:
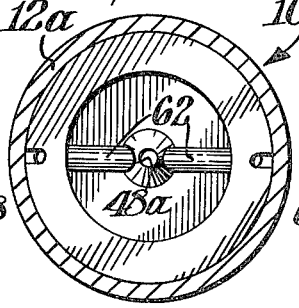
FIGS. 6–7 are cross-sectional views taken through FIG. 5 along the lines 6—6 and 7—7.
Figure 6:
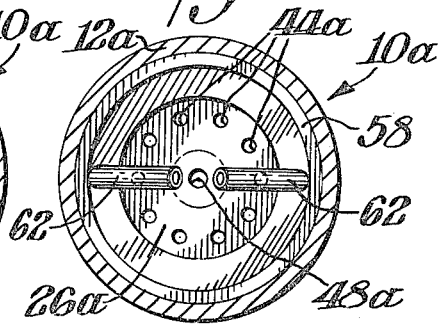
Figure 5:
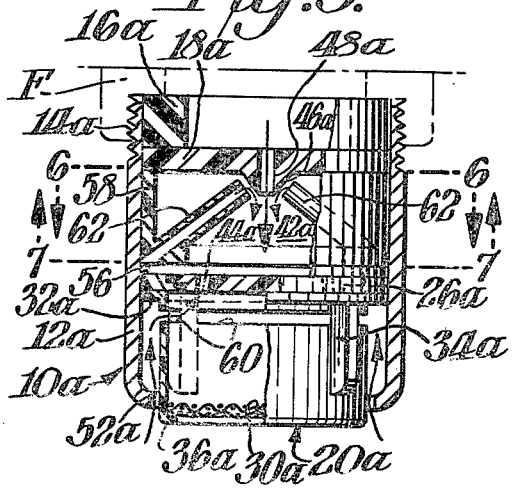
FIG. 5 is a cross-sectional view in elevation of a modified aerator in accordance with a further embodiment of this invention.
Figure 3:
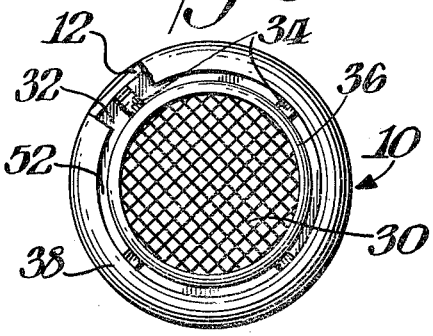
FIG. 3 is a bottom plan view partly broken of the aerator shown in FIGS. 1–2.

FIGS. 5–7 shows an alternative form of this invention wherein like reference numerals are used for like parts and wherein the suffix "a" is used. As indicated therein, sleeve **20*a* is closed at its upper end by dispersal disc 26*a* having apertures 44*a* extending therethrough. A thin spacer ring 56 is mounted on top of dispersal disc 26*a* and a cylindrical shell 58 is placed on spacer ring 56. Flow control member 18*a* and gasket 16*a* are next located in body member 12*a*, as previously described. Air enters body member 12*a* through annular opening 52*a*, as previously described, and is drawn upwardly through the annular space between shell 20*a* and body member 12*a*. The air then flows through slots 60 in shell 20*a* and flows through the same apertures 44*a* through which the aerated water flows. Air is then drawn into upwardly and inwardly inclined tubes 62 which may be integral with shell 58 or otherwise secured thereto and which terminates adjacent the frusto-conical outer surface of extension 46*a* whereby the air and water are mixed in mixing chamber 42*a***, as previously described.

Although, as indicated above in the FIGS. 5–7 embodiment, the air is drawn into tubes 62 by first passing through apertures **44*a*, if desired, separate passageways may be provided through flange 32*a* and dispersal disc 26*a* in line with the upstream end of tubes 62. It is also to be understood that although a pair of tubes are illustrated, any suitable number of such tubes may be provided. It is preferred that the inclination of tubes 62 be such that the tubes terminate at an angle corresponding to the angle of the frusto-conical extension 46*a***.

Figure 2:
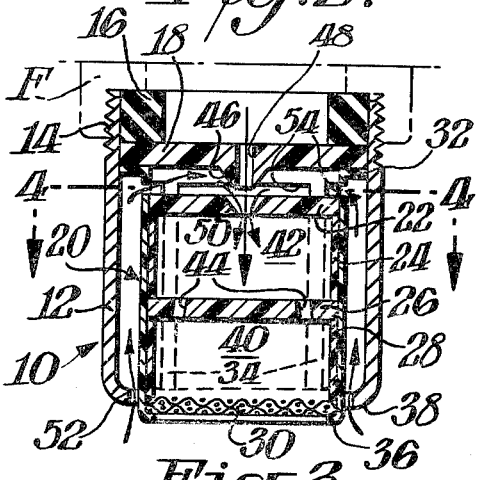
FIG. 2 is a cross-sectional view in elevation taken through FIG. 1 along the line 2—2.
Figure 8:
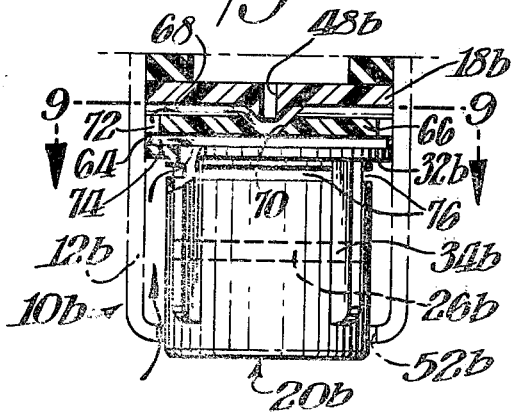
FIG. 8 is a cross-sectional view in elevation of yet another aerator in accordance with this invention.
Figure 4:
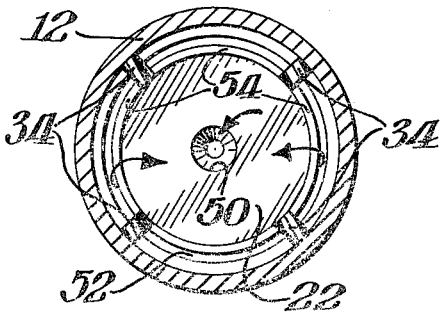
FIG. 4 is a cross-sectional view taken through FIG. 2 along the line 4—4.
Figure 9:
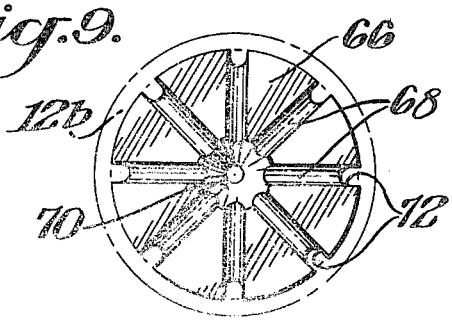
FIG. 9 is a cross-sectional view taken through FIG. 8 along the line 9—9.

FIGS. 8–9 show yet another embodiment of this invention wherein body member **12*b* includes a shell 20*b* containing screen material at its discharge or downstream end and a dispersal disc at an intermediate portion thereof similar to that shown in FIG. 2. In the embodiment of FIGS. 8–9, a thin spacer ring 64 is mounted on flange 32*b* and the upstream end of sleeve 20*b* is then, in essence, closed by air channel forming disc 66 which rests on spacer ring 64. Flow control member 18*b* is then placed against air channel forming disc 66. As shown in FIG. 9, a plurality of radial grooves 68 is provided in the upper surface of disc 66. Disc 66 also includes a tapered opening 70 similar to opening 50 of FIG. 2. The peripheral edge of disc 66 also includes a plurality of notches or indents 72, one of which is provided for each groove 68 so that the grooves 68 communicate with the space 74 provided inwardly of spacer ring 64 whereby the air may enter body member 12*b* through annular passage 52*b* and then flow through the annular space between sleeve 20*b* and body member 12*b*. The air would then pass through slots 76 in sleeve 20*b* and then into space 74 through notches 72 and grooves 68 for mixing with the water as it emerges from extension 48*b***.

It is to be understood that although eight such grooves 68 are shown in FIG. 9, any such number of grooves may be provided. In essence, the embodiment of FIGS. 8–9 operates similar to the embodiment of FIGS. 1–4 where, in effect, the embodiment of FIGS. 1–4 has an infinite number of grooves by an endless annular space being provided between air forming channel disc 22 and flow control member 18 rather than a specific number of grooves being provided between those members, as shown in FIG. 9.

Any suitable materials known in the art may be used for the various components of the inventive aerator. As can be appreciated in each of the embodiments, however, the various components are easy to assemble and thus may be manufactured at low cost while providing a particularly effective manner of aerating the water at significantly lower flow rates than heretofore achievable.

What is claimed is:

1. An aerator for attachment to a water faucet or the like comprising a hollow open-ended body member having an upstream inlet end and a downstream discharge end, securing means at said upstream end of said body member for connection to a faucet in flow communication therewith, a flow control member in said body member at said upstream end having a restricted passageway and orifice for directing a stream of water toward said downstream end, air passage means in said body member for directing atmospheric air at the stream of water as it emerges from said orifice for aerating the water at the upstream end of said body member in a mixing chamber downstream from said flow control member with said flow control member being at the upstream end of said mixing chamber, and said air passage means confining the flow of air from the atmosphere to said orifice at the point of maximum pressure drop whereby said aerator is capable of aerating at a low flow rate.

2. The aerator of claim 1 including a dispersal disc in said body member downstream from said flow control member at the downstream end of said mixing chamber, said dispersal disc having a plurality of openings therethrough for the passage of the aerated water toward said downstream end, and screen material at said downstream end of said body member for breaking up and rewelding the aerated water discharged from said body member.

3. The aerator of claim 2 wherein air passge means directs air from the atmosphere at said downstream end of said body member and through said body member along side said mixing chamber and then toward said restricted orifice.

4. The aerator of claim 3 wherein said flow control member includes a frusto-conical extension extending toward said dispersal disc, said restricted passageway being located in said extension, and the outer surface of said extension being part of said air passage means for guiding the air toward said orifice at the end of said extension.

5. The aerator of claim 4 including a sleeve disposed coaxially within said body member generally coterminous therewith and spaced therefrom to create an annular space therebetween, said screen material spanning said sleeve at its downstream end thereof, said dispersal disc spanning said sleeve at an intermediate portion thereof, said mixing chamber being in the portion of said sleeve upstream from said dispersal disc, and said annular space comprising a portion of said air passage means.

6. The aerator of claim 5 including a plurality of spacer ribs extending from said sleeve and juxtaposed the inner wall of said body member.

7. The aerator of claim 6 including an air channel forming disc spanning the upstream end of said sleeve adjacent to and spaced from said flow control member, a tapered axial aperture in said air channel forming disc, and the space between said flow control member and said air channel forming disc being a part of said air passage means.

8. The aerator of claim 7 wherein the space between said air channel forming disc and said dispersal disc is of the same volume as the space between said dispersal disc and said screen material.

9. The aerator of claim 6 including an air channel forming disc disposed against and downstream from said flow control disc, said air channel forming disc having a tapered axial opening conforming to and spaced from said frusto-conical extension, a plurality of radial grooves in the upstream surface of said air channel forming disc extending from said axial opening to the outer edge of said air channel forming disc, and said grooves communicating with said annular space through notches in said outer edge.

10. The aerator of claim 9 including slots in said sleeve upstream from said dispersal disc, and said notches communicating with said annular space through said slots.

11. The aerator of claim 4 wherein said air passage means includes a plurality of tubes extending from the inner wall of said body member and inclined inwardly toward said extension.

12. The aerator of claim 11 including a sleeve disposed coaxially within said body member generally coterminous therewith and spaced therefrom to create an annular space therebetween, said screen material spanning said sleeve at its downstream end thereof, said dispersal disc spanning said sleeve at its upstream end thereof, and said tubes communicating with said annular space.

13. The aerator of claim 12 including slots in said sleeve whereby said tubes communicate with said annular space through said slots and said dispersal disc.

14. The aerator of claim 1 wherein said flow control member is a disc with said orifice being axially located therethrough, said air passage means including an air channel forming disc disposed against and downstream from said flow control disc, an axial aperture in said air channel forming disc communicating with said orifice and a plurality of radial grooves in one of the contacting surfaces between said flow control disc and said air channel forming disc whereby air may flow through said grooves into communication with the water emerging from said orifice.

* * * * *